US006813792B2

(12) United States Patent
Miller

(10) Patent No.: US 6,813,792 B2
(45) Date of Patent: Nov. 9, 2004

(54) GANGWAY INCLUDING AN ARTICULATED RAMP AND LADDER

(76) Inventor: Robert Edward Miller, 4296 SE. Cove Lake Cir., #107, Stuart, FL (US) 34997

( * ) Notice: Subject to any disclaimer, the term of this patent is extended or adjusted under 35 U.S.C. 154(b) by 0 days.

(21) Appl. No.: 10/313,352

(22) Filed: Dec. 6, 2002

(65) Prior Publication Data

US 2003/0106173 A1 Jun. 12, 2003

Related U.S. Application Data

(60) Provisional application No. 60/341,004, filed on Dec. 7, 2001.

(51) Int. Cl.[7] ..... E01D 15/00; B63B 27/00

(52) U.S. Cl. ..... 14/69.5; 14/71.1; 14/72.5; 414/139.4

(58) Field of Search ..... 14/69.5, 71.1, 14/72.5; 414/139.4; 182/2; 108/144, 115; 189/1, 95, 96, 121

(56) References Cited

U.S. PATENT DOCUMENTS

| | | | | | |
|---|---|---|---|---|---|
| 501,694 | A | * | 7/1893 | Richards | 182/1 |
| 2,536,966 | A | * | 1/1951 | Clarence | 182/95 |
| 3,604,532 | A | * | 9/1971 | Moore | 182/93 |
| 3,892,290 | A | * | 7/1975 | Lang | 182/22 |
| 4,211,307 | A | * | 7/1980 | Ethridge | 182/121 |
| 4,311,209 | A | * | 1/1982 | Primerano et al. | 182/206 |
| 4,333,196 | A | * | 6/1982 | Bougaran | 14/71.7 |
| 4,366,591 | A | | 1/1983 | Zimmerman | |
| 4,538,314 | A | * | 9/1985 | Baranowski | 14/71.1 |
| 4,869,520 | A | * | 9/1989 | Cole | 280/164.1 |
| 4,971,168 | A | * | 11/1990 | Stanescu | 182/1 |
| 4,998,313 | A | | 3/1991 | Lippka et al. | |
| 5,052,515 | A | * | 10/1991 | Nowlan | 182/121 |
| 5,224,437 | A | | 7/1993 | Stanescu | |
| 5,505,579 | A | * | 4/1996 | Ray et al. | 414/462 |
| 5,657,832 | A | * | 8/1997 | Stevens | 182/1 |
| 5,794,292 | A | | 8/1998 | Ricci, Jr. | |
| 5,829,380 | A | * | 11/1998 | Smith | 114/362 |
| 5,924,521 | A | * | 7/1999 | Crockett | 182/95 |
| 5,950,267 | A | | 9/1999 | Ricci, Jr. | |
| 6,598,562 | B1 | * | 7/2003 | Dutkiewicz et al. | 119/706 |
| 2003/0178252 | A1 | * | 9/2003 | Schmid, Jr. | 182/84 |

FOREIGN PATENT DOCUMENTS

| | | | | |
|---|---|---|---|---|
| FR | 2438578 | * | 5/1980 | B63B/29/20 |

* cited by examiner

*Primary Examiner*—Robert E. Pezzuto
*Assistant Examiner*—Raymond W Addie
(74) *Attorney, Agent, or Firm*—Ronald V. Davidge

(57) ABSTRACT

A gangway includes a ladder, which is removably attachable to extend along a side of a boat, and a ramp, which is removably and pivotally attachable to the ladder at a number of vertically spaced locations. The ladder may include a step that is pivoted to extend outward for use with the ramp attached at or below the step. The gangway may also include a removable step that can be attached to the ladder at the locations provided for attachment of the ladder.

16 Claims, 9 Drawing Sheets

GANGWAY INCLUDING AN ARTICULATED RAMP AND LADDER

CROSS-REFERENCE TO A RELATED APPLICATION

This application claims the benefit of U.S. Provisional Application, No. 60/341,004, filed Dec. 7, 2001.

BACKGROUND OF THE INVENTION

1. Field of the Invention

The invention relates to a gangway for movement of individuals between a dock and a boat, and, more particularly, to such a gangway having provisions allowing for variations in the vertical distance between the boat deck and the dock and additionally having provisions for changes in the configuration of the gangway to accommodate different docks.

2. Summary of the Background Art

Since ancient times, people have devised numerous devices, generally known as gangways or gangplanks, to facilitate the movement of individuals between docks and boat decks. A simple device for this purpose is a plank or ramp, wide enough to walk safely along, extending upward or downward to the deck of a ship from the dock. However, a problem with such a simple solution quickly arises from the magnitude of the vertical distance between the dock surface and the boat deck and because of variations occurring in this distance. Such variations may occur slowly, with changes in tidal levels, or very rapidly, as with waves caused by passing boats. A ramp to be used in a conventional manner, i.e. walking, not crawling or climbing up and down, for pedestrian traffic should not have a slope steeper than about fifteen degrees. Fulfilling this requirement, together with the requirement to provide for the magnitude and changes in the vertical distance between a dock and a boat deck often results in a ramp that is much too long to use in a number of docking situations. Furthermore, even when such a long ramp can be accommodated on the dock, it is often too bulky and heavy for easy movement and storage.

Much steeper angles are easily handled by providing steps, in the form of a stairway, instead of a ramp. However, since a stairway is easily used only when its individual steps are nearly level, the inclination of a conventional stairway cannot be used to compensate for significant changes in the vertical distance between the dock surface and the deck height. Compensation for such changes is needed if the gangway is to be used on a particular boat with a number of different docks, on a particular dock with a number of different boats, or, in many instances in a particular application under conditions of tidal changes and waves from passing boats.

One solution for this problem is to provide a stairway with pivotable steps and with a linkage causing the steps to pivot with changes in the inclination of the stairway so that the steps remain level. Stairways of this kind are described, for example, in U.S. Pat. Nos. 5,657,832, 5,794,292, and 5,950,267. However, the mechanism required for providing this function tends to make the stairways complex, heavy, and therefore difficult to move. Furthermore, unless pinch points in the mechanism are avoided, injury can result from becoming caught between parts moving rapidly and with great force when the boat to which the stairway is attached moves up and down with waves from a passing boat. In this regard, U.S. Pat. No. 5,794,292 describes a method for reducing the effects of pinch points between adjacent steps. Thus, what is needed is a method allowing the use of a simple ramp, not having steps, to accommodate relatively small variations in the vertical distance between a deck and a dock, together with another means to accommodate larger, slowly occurring changes in such a distance.

Another way to provide additional flexibility in the configuration of a gangway is to provide an articulated structure, with two or more sections pivotally connected. Such sections may include ramps and/or stairways. Examples of such articulated structures are described in U.S. Pat. Nos. 4,133,067, 4,366,591, 4,998,313, and 5,224,437. However, the flexibility of such structures is still limited by fact that the sections are connected in a way allowing only pivotal motion, and by the practical limitations on variations in the inclination of the individual sections. What is needed is an articulated structure having additional flexibility in the way its sections are connected, so that such flexibility can be used to accommodate large variations in the vertical distance between the dock surface and the boat deck, while changes in the inclination of a portion of the structure, such as a ramp are used to accommodate smaller, rapidly-occurring changes in this vertical distance.

SUMMARY OF THE INVENTION

In accordance with the present invention, a gangway includes a ramp configured for placement on a dock and a ladder provided with means for attachment to the deck of a boat. The ladder includes a number of steps and a number of corresponding attachment locations from which the ramp may be pivoted.

Apparatus used to board a boat should provide for safe and convenient movement in both directions between a dock and the deck of the boat, in spite of variations in the level of the boat. For example, some of such variations occur slowly, with the tidal level of the water in which the boat is floating or with seasonal variations in the water level of a lake, while others of such variations occur rapidly, as the boat is moved by the wake of a passing vessel.

In the present invention, the slowly occurring variations are accommodated by providing a number of locations at which the ramp can be attached to the ladder and by pivotally attaching the ramp to the ladder. While changes in the slope of the ramp perform part of this accommodation, different attachment locations can be used to limit the slope to one that can be easily traversed. Rapid changes in the level of the boat are also accommodated by the pivoting of the ramp on the ladder. Since only this pivoting motion occurs with rapid changes in the water level, pinch points, which could otherwise cause injuries, are avoided.

DETAILED DESCRIPTION OF THE INVENTION

Figure 1:
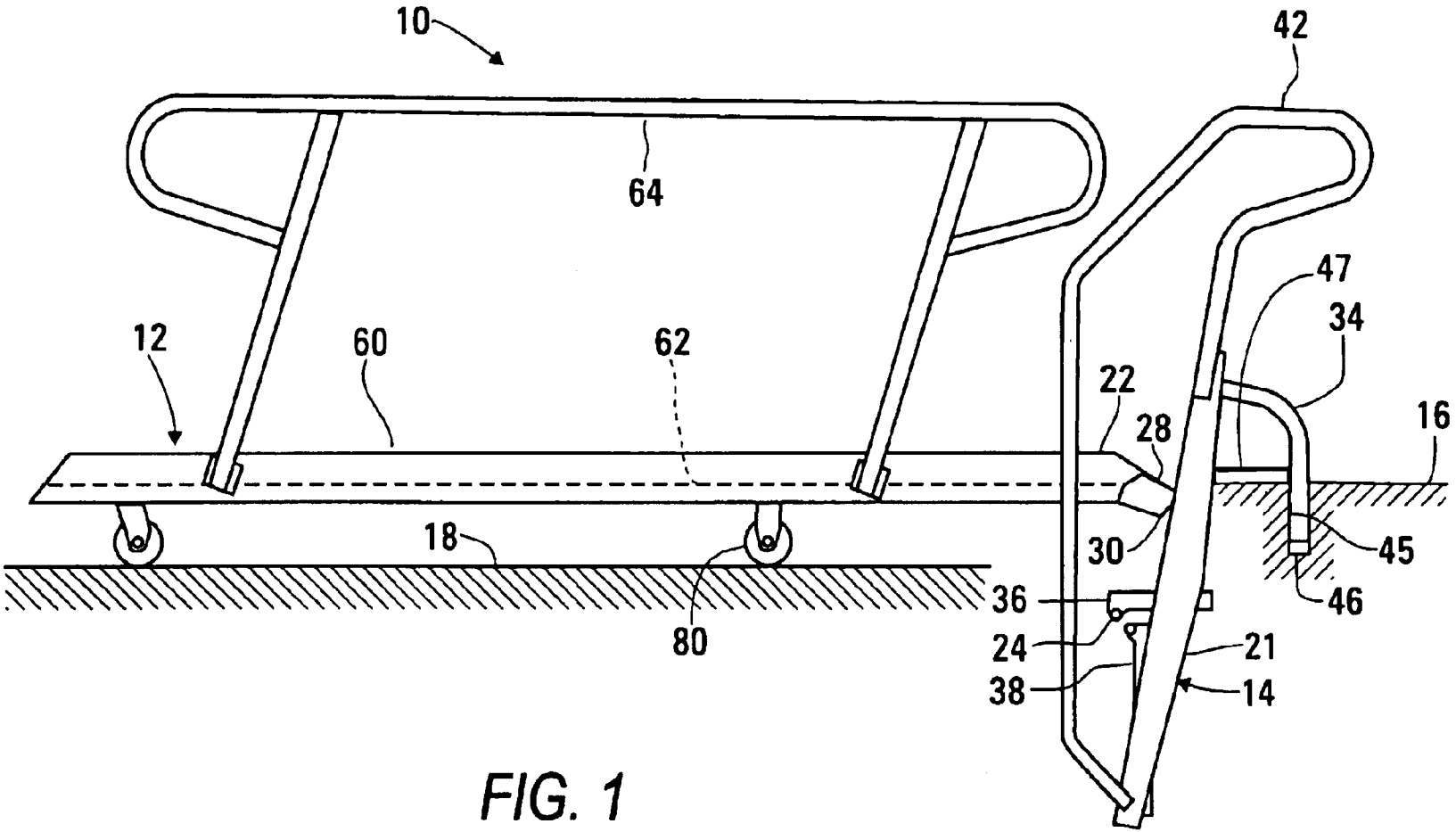
FIG. 1 is a side elevation of a gangway built in accordance with a first embodiment of the invention and assembled to accommodate a minimum vertical distance between a dock and the boat deck, shown with a low water level.
Figure 2:
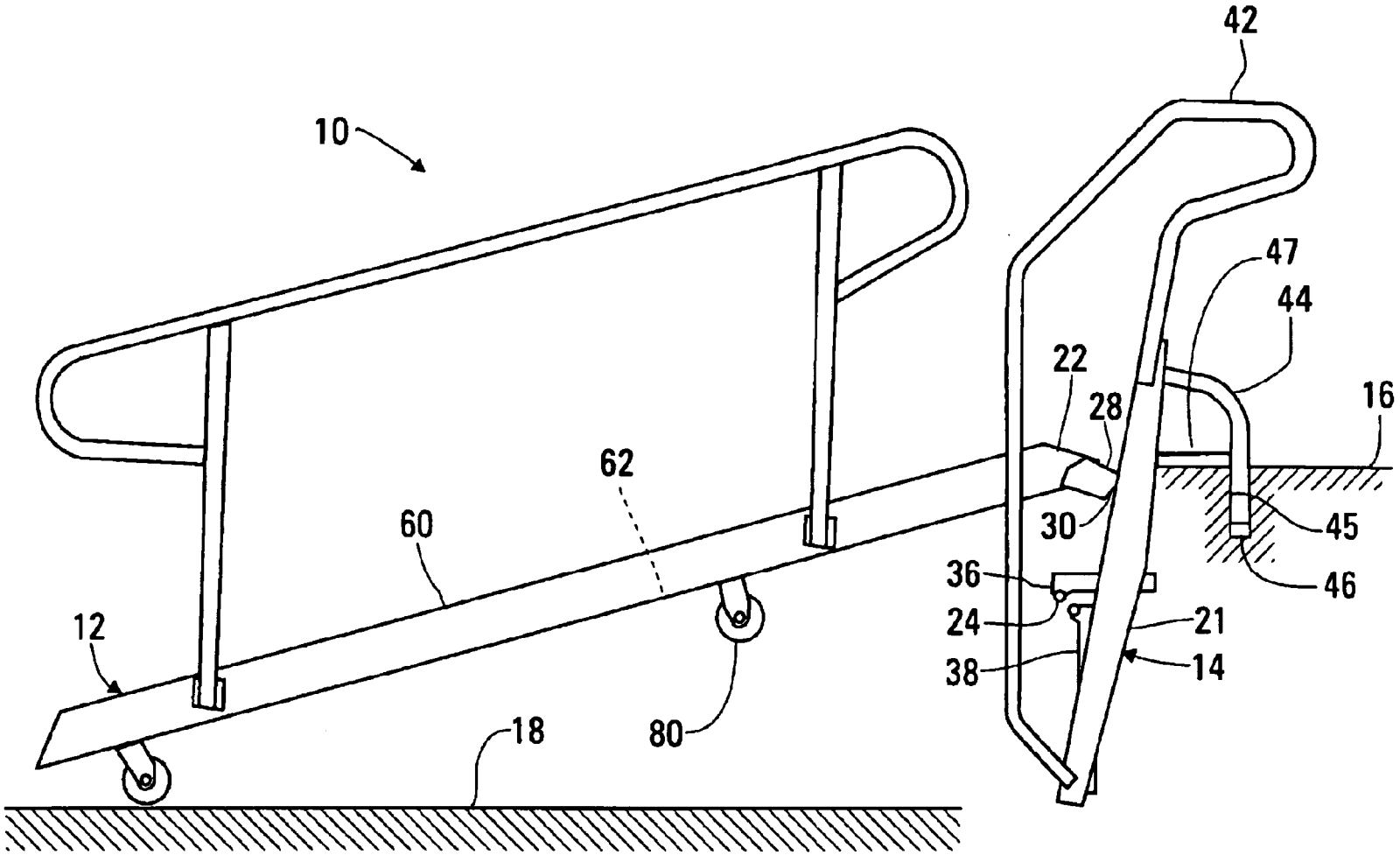
FIG. 2 is a side elevation of the gangway of FIG. 1, assembled as shown in FIG. 1, shown with a higher water level.

FIGS. 1 and 2 are side elevations of a gangway 10 including a ramp 12 and ladder 14, built in accordance with a first embodiment of the present invention to accommodate variations in the water level, and hence in the vertical distance between a deck surface 16 of a boat and a dock surface 18.

Figure 3:
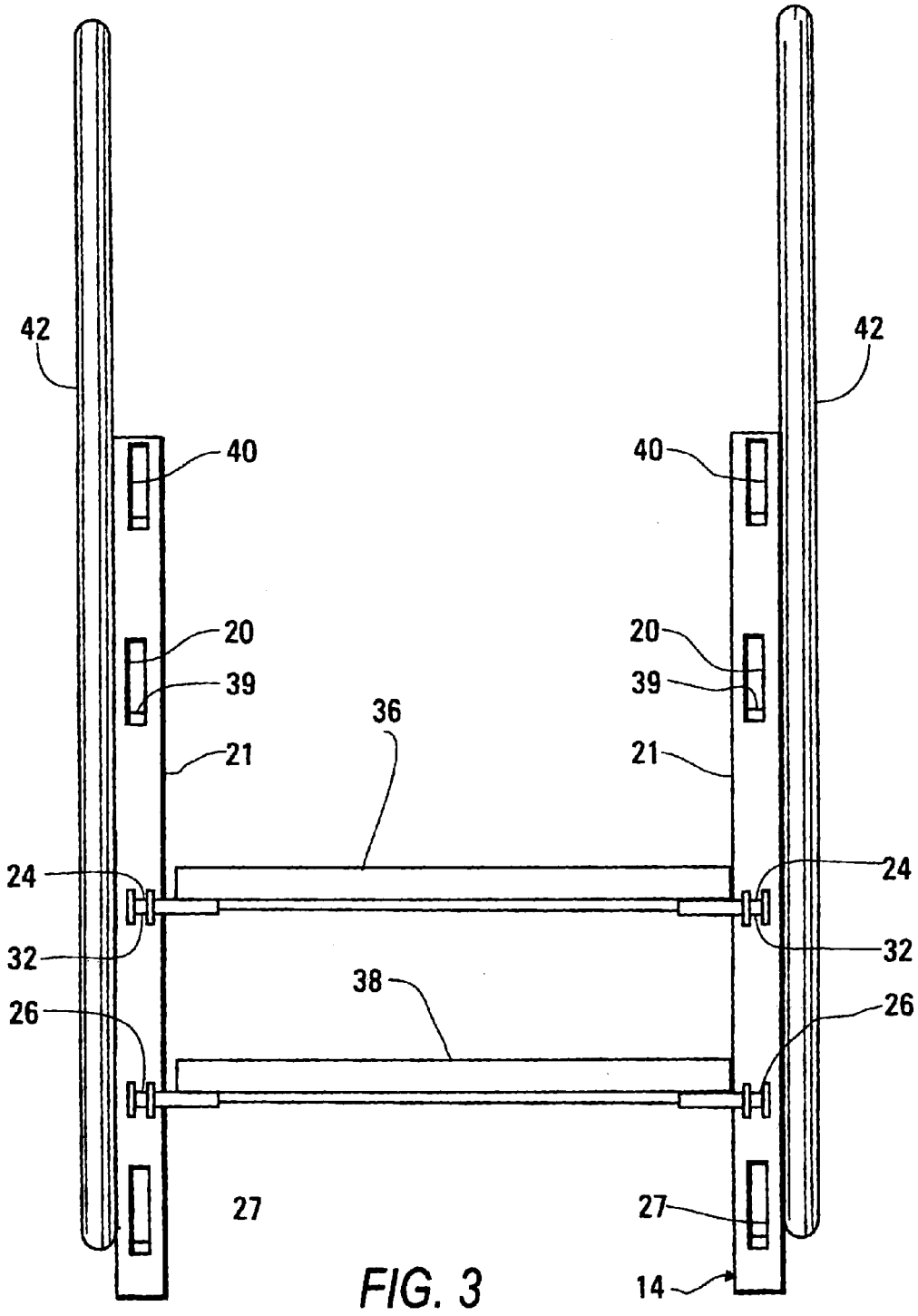
FIG. 3 is a fragmentary front elevation of the ladder within the gangway of FIG. 1.

FIG. 3 is a front elevation of the ladder 14, showing the various locations at which the ramp 12 is attached to accommodate various ranges in this vertical distance.

In FIGS. 1 and 2, the gangway 10 is shown with the ramp 12 attached within a pair of slots 20 (shown in FIG. 3) in the box-shaped side frames 21 forming the sides of the ladder 14. This attachment location places the end 22 of the ramp 12 near the level of the deck surface 16 with a low water level, as shown in FIG. 1. In the example of FIG. 2, an increase in the water level has been accommodated by a change in the slope of the ramp 12.

A number of points for attachment of the ramp 12 to the ladder 14 are provided to accommodate significant differences in the vertical distance between the boat deck 16 and the dock surface 18. In some instances, such significant differences occur only when the boat is moved from one dock to another. In other instances, such differences are also encountered with changes in tidal conditions, so that the ladder 14 is moved form one attachment location to another with tidal changes. For example, if the vertical distance between the boat deck 16 and the dock surface 18 is greater than the situation shown in FIG. 3, the point of attachment between the ramp 12 and the ladder 14 may be moved further down the ladder 14, to an intermediate attachment point 24 and to a lower attachment point 26.

Figure 4:
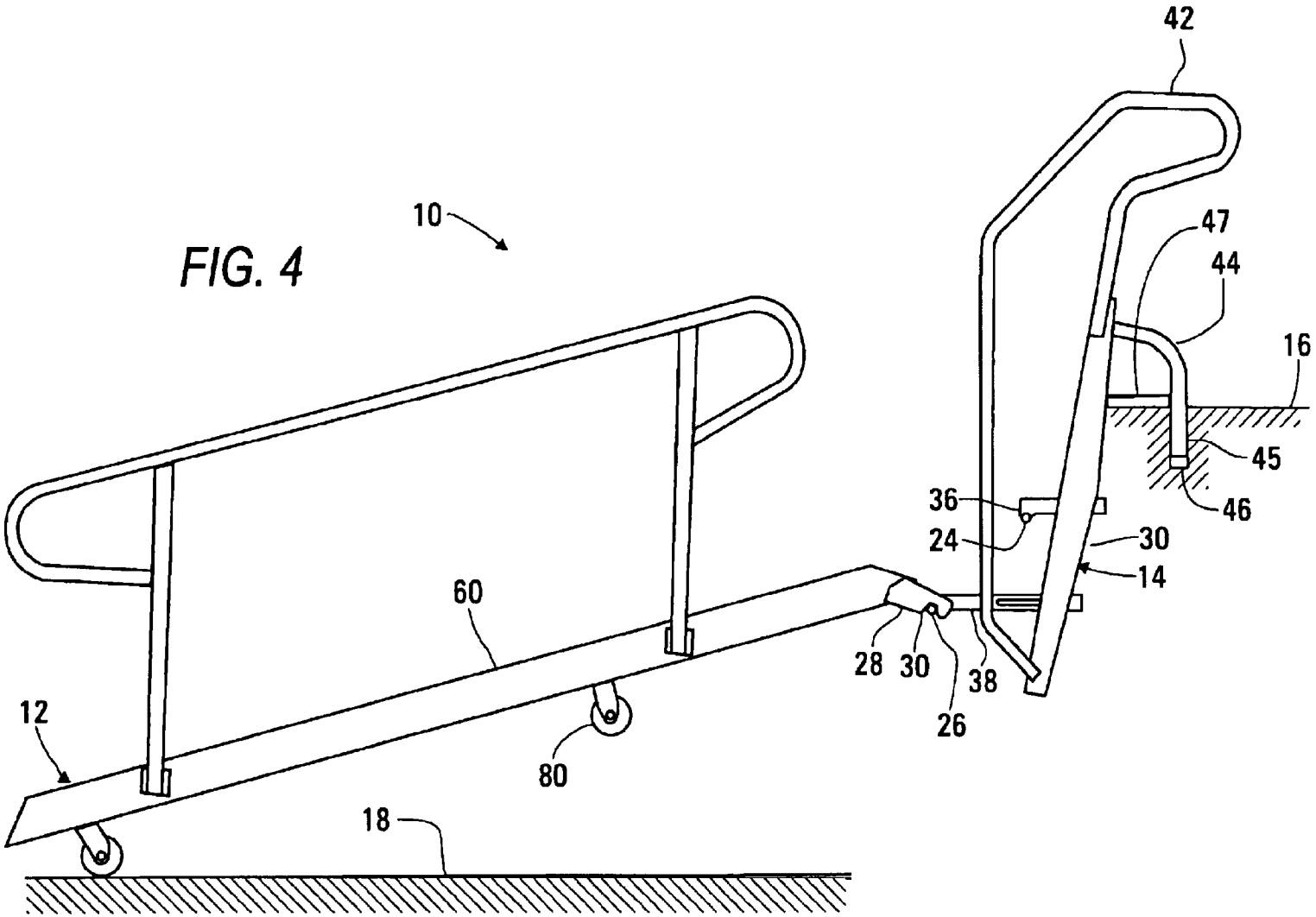
FIG. 4 is a side elevation of the gangway of FIG. 1, assembled to accommodate a greater vertical distance between a dock and the boat deck.

FIG. 4 is a side elevation of the gangway 10 with the ramp 12 attached at the lower attachment point 26 to accommodate a fairly great vertical distance between the boat deck 16 and the dock surface 18. An even greater vertical distance can be achieved by fastening the ramp 12 to the lowest attachment point at the lowest slots 27. The ramp 12 includes a pair of attachment brackets 28 having downward-facing slots 30 that are placed over attachment pins 32 extending from the ends of an upper step 36 and a lower step 38. Alternately, the attachment brackets 28 are placed over pins 39 within the slots 20, 27, and within an uppermost pair of slots 40 provided for use when the boat deck 16 is below the dock surface 18.

Figure 5:
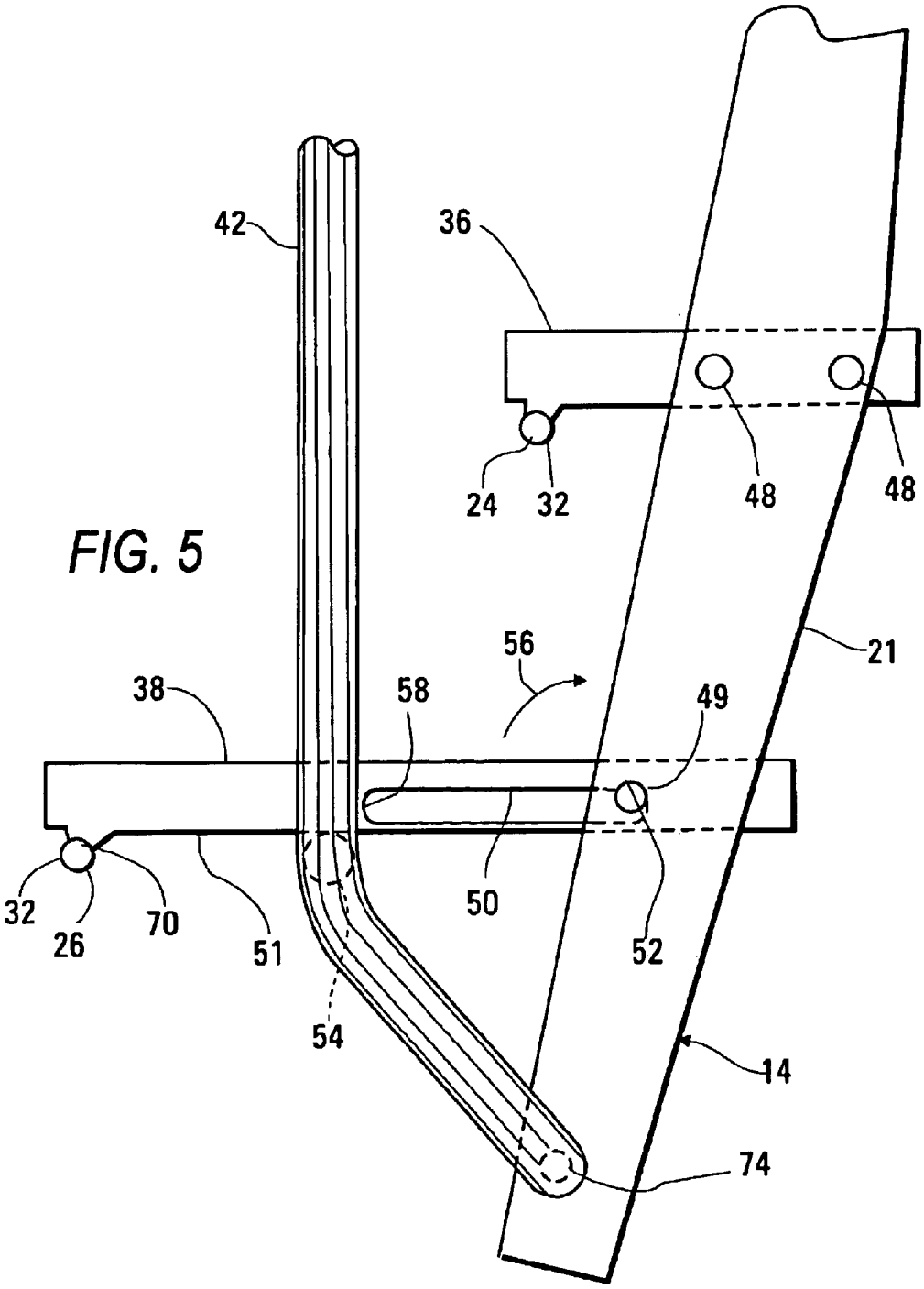
FIG. 5 is a fragmentary side elevation of the gangway of FIG. 1, showing the pivotable attachment of a lower step.

FIG. 5 is a fragmentary side elevation of the ladder 14 showing structural details. Referring to FIGS. 1 and 5, the ladder 14 includes a pair of box-shaped side frames 21, a pair of tubular handrail structure 42, a pair of tubular mounting structures 44, an intermediate step 36, and a lower step 38. The tubular mounting structures 44 are used to removably attach the ladder 14 to the deck 16 of a boat, with a pair of attachment legs 45 extending through holes 46 in the deck 16, and with tubular braces 47 extending along the surface of the deck 16. The intermediate step 36 is attached by a pair of fasteners 48, which may be rivets or bolts, at each end to one of the side frames 21. The combination of the intermediate step 36 extending between the side frames 21 and of the attachment legs 45 extending into holes 46 in the rigid boat deck 16 provides the ladder 14 with a rigid structure extending between the side frames 21.

The lower step 38 is pivotally and slidably fastened to each of the side frames 21 by means of a fastener 49, which may be a rivet or screw, preferably having a shoulder extending within a slot 50 in the end flange 51 of the lower step 38. The lower step 38 is used when the ramp 12 is fastened to the lower attachment point 26, as shown in FIG. 4, or when the ramp 12 is fastened to the lowest attachment slot 27, with the lower step 27 being used to step up from the ramp 12). When the lower step is 38 is used in this way, it is held in the position indicated in FIG. 5, with the fastener 46 extending within a detent portion 52 of the slot 50 at each end of the step 38, and with the lower surface of each end flange 51 resting on a pin 54 extending inward from the handrail structure 42. When the lower step 38 is not being used, it is pivoted upward, in the direction of arrow 56, and is slid downward until the end 58 of each of the slots 48 rests on the fastener 49. This pivoting movement brings the lower step 38 into a position in which it cannot collide with the dock structure 18 as the water level rises.

Referring to FIG. 1, the ramp 12 includes a side frame 60 extending along each side, a floor 62 extending between the side frames 60, and, fastened to each of the side frames 60, a tubular handrail structure 64 extending upward and an attachment bracket 28 at attached to each side frame 60 the end 22 of the ramp 12. When the ramp 12 is fastened at one of the slots 20, 27, 40, the attachment brackets 28 are pushed into the slots, so that the slots 30 in the attachment brackets 28 can be placed over the pins 39 within the side frames 21 of the ladder 14.

The articulated gangway 10 is easily attached and detached, and is otherwise held together by gravity. The use of wheels 80 also facilitates movement and storage of the gangway 10.

Figure 6:
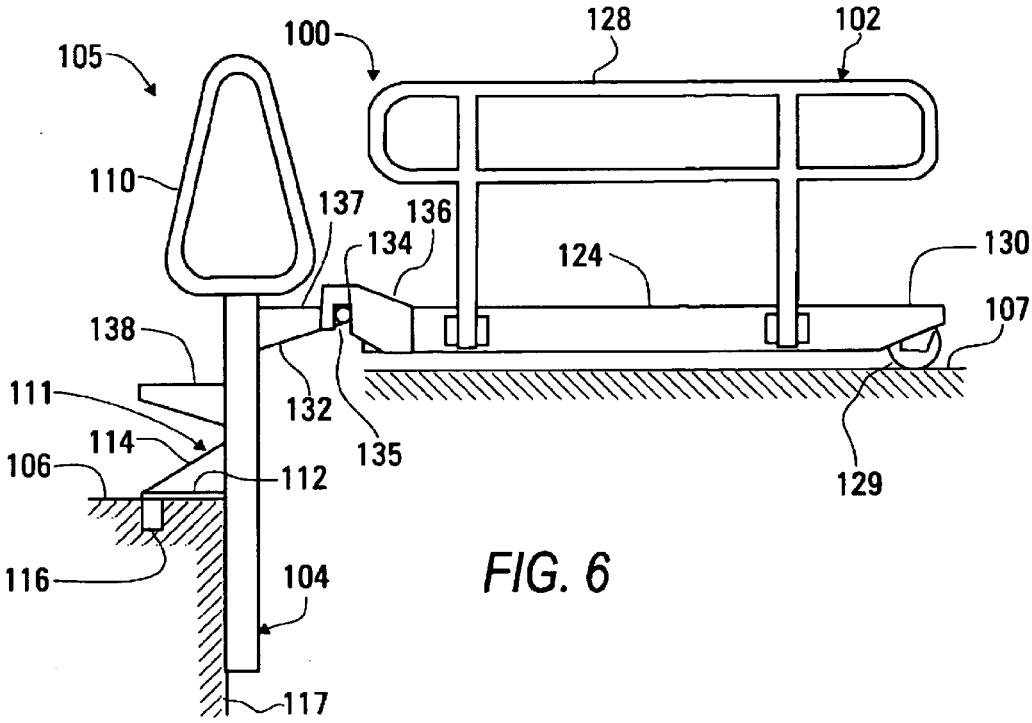
FIGS. 6 and 7 are side elevations of a gangway built in accordance with a second embodiment of the invention and assembled according to a first configuration, with FIG. 7 showing an increase in the elevation of a boat relative to a dock.
Figure 7:
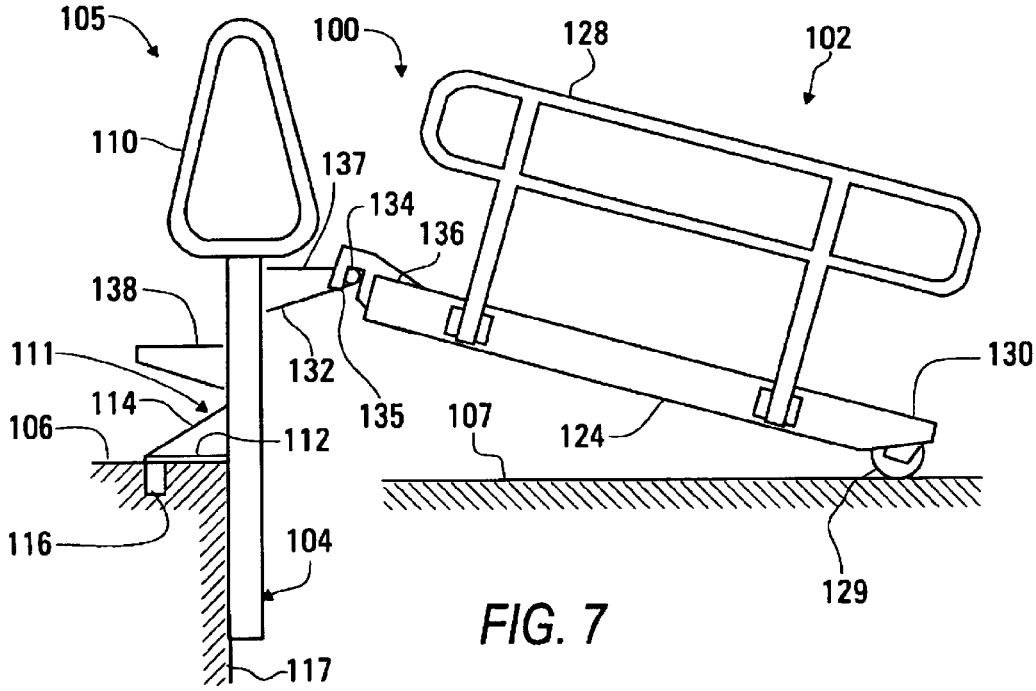

FIGS. 6 and 7 are side elevations of an articulated gangway 100 built in accordance with a second embodiment of the invention, including a ramp 102 and a ladder 104 assembled in a first configuration 105. The articulated gangway 100 can be assembled in a number of configurations to accommodate significant changes in the vertical distance between the deck 106 of a boat and the surface 107 of a dock. Of these configurations the first configuration 105, provides for the boat deck 106 to be substantially below the dock surface 107, as shown in FIG. 6, or to be elevated somewhat above the dock surface 107, as shown in FIG. 7, with the difference in these conditions being accommodated by a change in the angle of inclination of the ramp 102.

Figure 8:
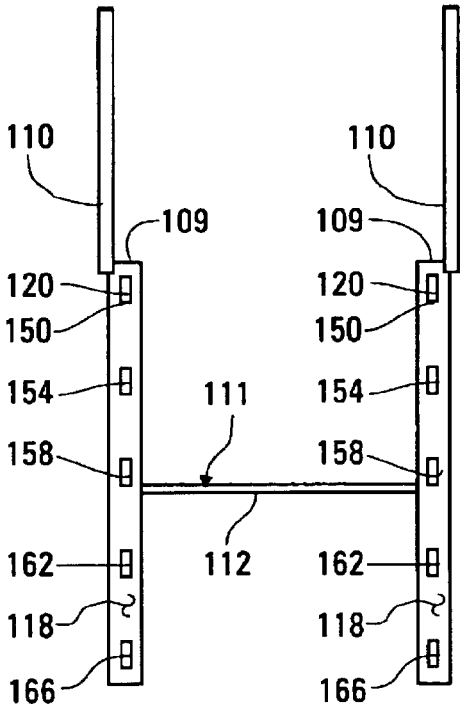
FIG. 8 is a front elevation of a ladder within the gangway of FIG. 6.
Figure 9:
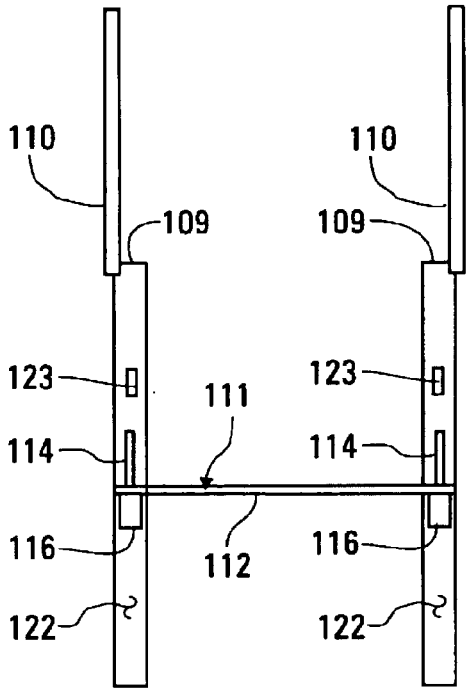
FIG. 9 is a rear elevation of the ladder of FIG. 8.
Figure 10:
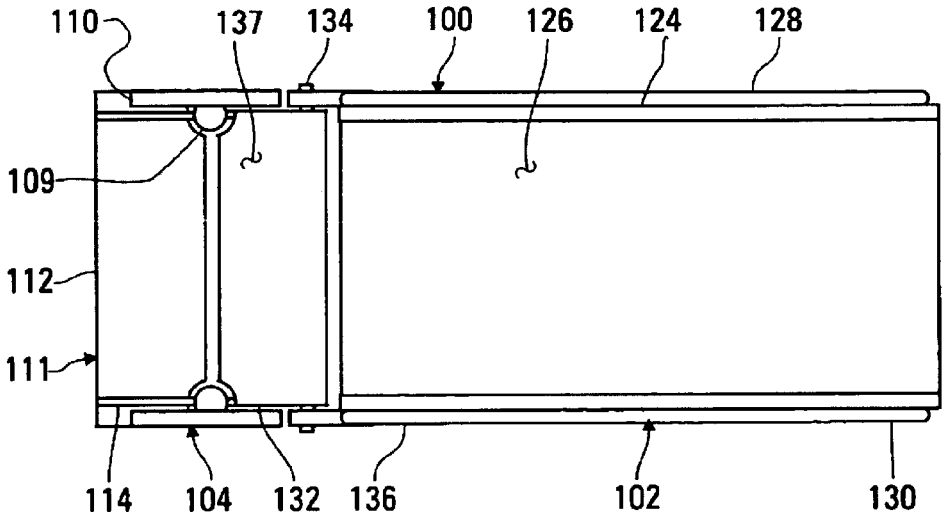
FIG. 10 is a plan view of the gangway of FIG. 6.

The ladder 104 will now be discussed, with particular reference being made to FIGS. 8–10. FIG. 8 is a front elevation of the ladder 104, as viewed from the dock with the ramp 102 removed; FIG. 9 is a rear elevation of the ladder 104, removed from the boat; and FIG. 10 is a plan view of the ladder 104 with the ramp 102 attached thereto.

The ladder 104 includes a pair of tubular side frames 109, a pair of formed tubular handle loops 110, and a boat mounting structure 111, which extends rearward from the side frames 109 and between the side frames 109 to provide rigidity for the ladder 104. The boat mounting structure 111 includes a horizontal plate 112 serving as a frame member attaching the side frames 109, a pair of triangular gussets 114, and a pair of downward-extending attachment pins 116. The ladder 104 is mounted the deck 106 of a boat with the attachment pins 116 extending down ward into holes provided in the deck 106 for this purpose, with the horizontal plate 112 extending along the surface of the deck, and with the ladder 104 extending downward along a side 117 of the boat. The front sides 118 of the side frames 109 include six pairs of attachment slots 120, while the rear sides 122 of these side frames 109 include one pair of attachment slots 123.

The ramp 102 will now be discussed with continuing reference to FIGS. 6 and 11. The ramp 102 includes a pair of side frames 124, a floor 126 extending between the side frames 124, a pair of railings 128 extending upward from the side frames 124, and a pair of rollers 129 rotatably mounted at a first end 130 of the ramp 102 to facilitate movement of this end of the ramp 102 along the dock surface 107. Preferably, the ramp 102 also includes an attachment bracket 132 pivotally mounted on the side frames 124 by a pair of pins 134 within slots 135 to extend from the end of the floor 126 at a second end 136 of the ramp 102, opposite the first end 130. The attachment bracket 132 provides a step surface 137 to step on at the end of the ramp 102 and further provides a means for the removable attachment of the ramp 102 to the ladder 104.

Preferably, the articulated gangway 100 further includes an additional step 138, which is used in certain assembled configurations of the gangway 100 to provide assistance in stepping up or down between the step surface 137 of the attachment bracket 132 and the boat deck 106.

Figure 11:
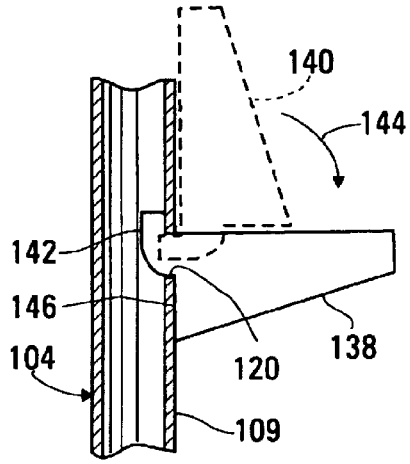
FIG. 11 is a fragmentary side view of the ladder of FIG. 8, showing the removable attachment of a step thereto.

FIG. 11 is a partly sectional fragmentary side elevation of the ladder 104 showing the removable attachment of the additional step 138 in one of the pairs of slots 120 in the ladder 104. The additional step 138 is brought into place in the orientation indicated by dashed lines 140, with tabs 142 of the step 138 extending within the slots 120. Next, the step is rotated downward, in the direction of arrow 144, into the position shown, to be held in place with gussets 146 of the step 138 held against the tubular side frame 109 by the weight of the additional step 138 and by the weight of anyone stepping on the step 138. The additional step 138 is removed from slots 120 for storage or for placement in another location by reversing this process, so that the tabs 142 can be withdrawn from the slots 120.

Referring again to FIGS. 6 and 11, the attachment bracket 132 of the ramp 102 additionally includes tabs 142 and gussets 146, as shown as parts of the additional step 138, so that the attachment bracket 132 can be installed on and removed from the ladder 104 in the manner described above in reference to FIG. 12. In this way, the attachment bracket 132 is used to provide for removable and pivotable attachment of the ramp 102 to the ladder 104. The attachment bracket 132 is also removably connected to the ramp 102 by virtue of the openings in slots 135, so that the procedure for attaching the attachment bracket 132 to the ladder 104, generally as described in reference to FIG. 11, can be easily performed with the ramp 102 not attached to the attachment bracket 132. Then, the ramp 102 is brought into place with the pins 134 engaged within the slots 135.

The removable attachment of the additional step 138 and of the attachment bracket 132 is readily used to build the articulated gangway 100 into a number of different configurations to accommodate differences in the vertical distance between the boat deck 106 and the dock surface 107. In the first configuration 105, shown in FIGS. 6 and 7, the additional step 138 is attached within the rear attachment slots 123 (shown in FIG. 9) of the ladder 104, while the attachment bracket 132 is attached within uppermost front attachment slots 150 (shown in FIG. 8), so that an individual boarding the boat steps down from the attachment bracket 132 to the additional step 138, and then to the boat deck 106.

Figure 12:
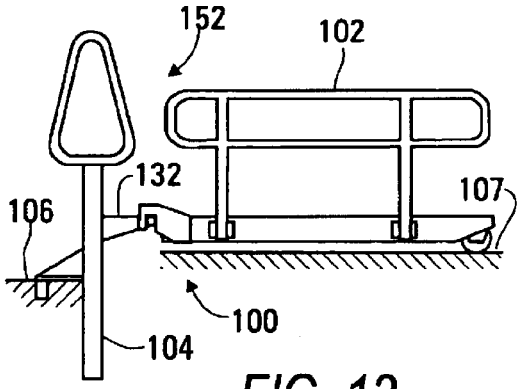
FIGS. 12 and 13 are side elevations of the gangway of FIG. 6, assembled according to a second configuration, with FIG. 13 showing an increase in the elevation of a boat relative to a dock.
Figure 13:
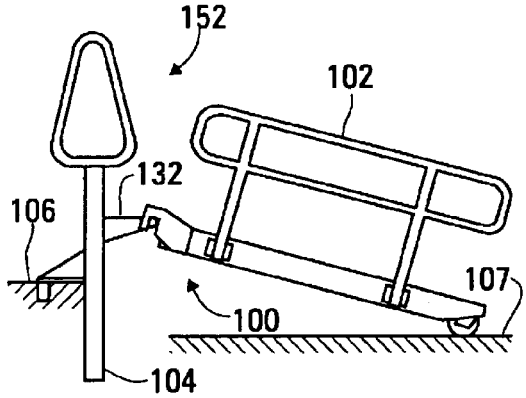

FIGS. 12–19 are each side elevations of the articulated gangway 100. FIGS. 12 and 13 show a second configuration 152, with an increase in the angle of the ramp 102 accommodating increased elevation of the boat deck 106 relative to the dock surface 107. In this second configuration 152, the additional step 138 is not used, and the attachment bracket 132 is attached within the second front attachment slots 154, so that an individual boarding to boat steps down to the boat deck 106 from the attachment bracket 132.

Figure 14:
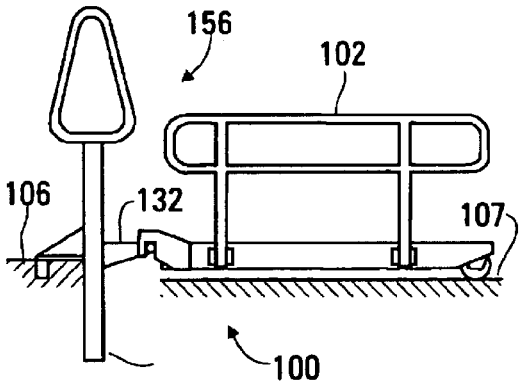
FIGS. 14 and 15 are side elevations of the gangway of FIG. 6, assembled according to a third configuration, with FIG. 15 showing an increase in the elevation of a boat relative to a dock.
Figure 15:
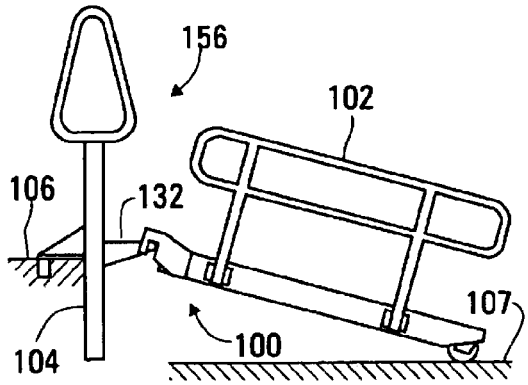

FIGS. 14 and 15 show a third configuration 156, with an increase in the angle of the ramp 102 accommodating increased elevation of the boat deck 106 relative to the dock surface 107 in FIG. 15. In this third configuration 156, the additional step 138 is not used, and the attachment bracket 132 is attached within the third front attachment slots 158, making the attachment bracket 132 essentially level with the boat deck 106.

Figure 16:
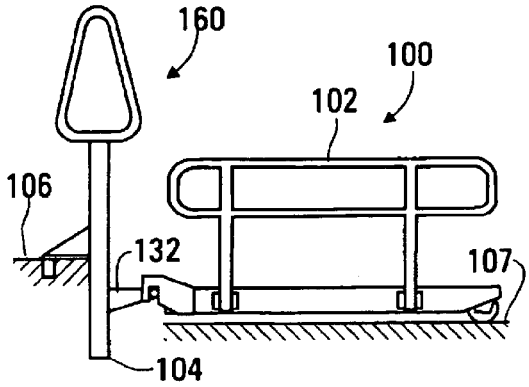
FIGS. 16 and 17 are side elevations of the gangway of FIG. 6, assembled according to a fourth configuration, with FIG. 17 showing an increase in the elevation of a boat relative to a dock.
Figure 17:
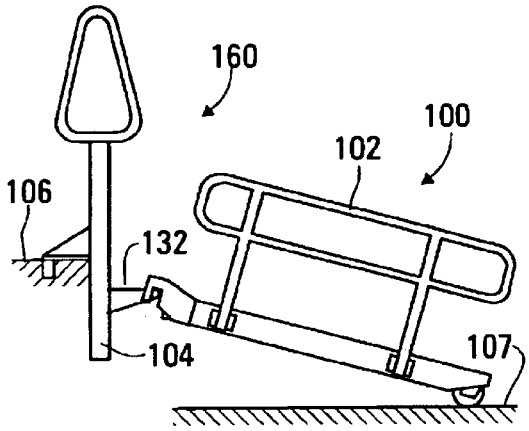

FIGS. 16 and 17 show a fourth configuration 160, with an increase in the angle of the ramp 102 accommodating increased elevation of the boat deck 106 relative to the deck surface 107 in FIG. 17. In this fourth configuration 160, the additional step 138 is not used, and the attachment bracket 132 is attached within the fourth front attachment slots 162, so that an individual boarding the boat steps up from the attachment bracket 132 to the boat deck 106.

Figure 18:
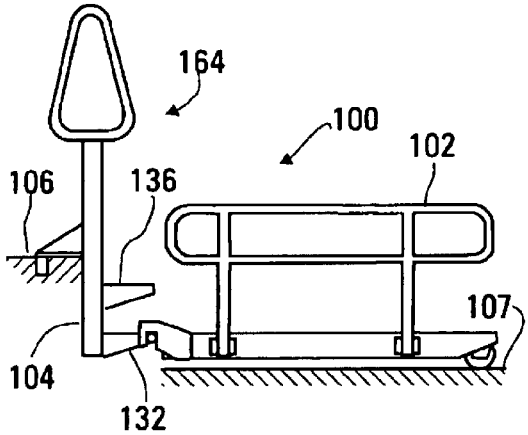
FIGS. 18 and 19 are side elevations of the gangway of FIG. 6, assembled according to a fifth configuration, with FIG. 19 showing an increase in the elevation of a boat relative to a dock.
Figure 19:
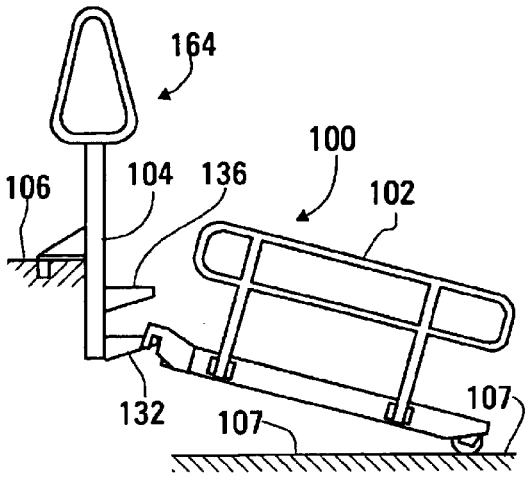

FIGS. 18 and 19 show a fifth configuration 164, with an increase in the angle of the ramp 102 accommodating increased elevation of the boat deck 106 relative to the deck surface 107 in FIG. 19. In this fifth configuration 164, the additional step 138 is attached within the fourth attachment slots 162, and the attachment bracket 132 is attached within the fifth front attachment slots 166, so that an individual boarding the boat steps up from the ramp 102, first to the additional step 138, and then to the boat deck 106.

Figure 20:
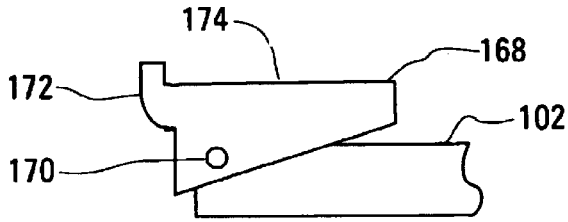
FIG. 20 is a side elevation of an alternative version of an attachment bracket pivotally attached to a ramp in the gangway of FIG. 6.

FIG. 20 is a side elevation of an alternative version of an attachment bracket 168, which is pivotably attached to the ramp 102 by means of pins 170 extending outward from the ramp 102. The attachment bracket 168, which is installed to be held in place within the ladder by tabs 172 in the general manner described above ain reference to FIG. 11, provides a step surface 174 extending above an end of the ramp 102.

While the invention has been described in terms of preferred embodiments with some degree of particularity, it is understood that this description has been given only by way of example, and that numerous changes can be made in the configuration or arrangement of parts without departing from the spirit and scope of the invention.

What is claimed is:

1. A gangway to accommodate passage between a dock and a boat, wherein said gangway comprises;

a ladder including a boat mounting structure for removably attaching said ladder to extend downward along a side of said boat and a plurality of vertically spaced apart ramp mounting structures, and a pair of horizontally spaced apart side frames and a step extending between said horizontally spaced apart side frames; and a ramp including an attachment structure removably attachable to each of said ramp mounting structures to pivotally attach said ramp to extend to said dock from said ladder, wherein each of said ramp mounting structures comprises a pair of cylindrical surfaces spaced apart horizontally, wherein said ramp mounting structures include a pair of cylindrical surfaces extending from said step, and wherein said attachment structure comprise a bracket having a downwardly open slot for engaging each pair of said cylindrical surfaces spaced apart horizontally.

2. The gangway of claim 1, wherein said pair of horizontally spaced apart side frames include a pair of horizontally spaced apart slots, said ramp mounting structure include a pair of pins forming cylindrical surfaces extending within said side frames adjacent said horizontally spaced apart slots, and said brackets within said attachment structure extend within said horizontally spaced apart slots to engage said pair of pins.

3. The gangway of claim 1, wherein said plurality of vertically spaced apart ramp mounting structures include a ramp mounting structure above said pair of cylindrical surfaces extending from said step, and said step is moveable between a position extending downward between said horizontally spaced apart side frames and a position extending outward from said horizontally spaced apart side frames.

4. A gangway to accommodate passage between a dock and a boat, wherein said gangway comprises;

a ladder including a boat mounting structure for removably attaching said ladder to extend downward along a side of side boat, a plurality of vertically spaced apart ramp mounting structures, a pair of horizontally spaced apart side frames, and a step extending between said horizontally spaced apart side frames, wherein each of said ramp mounting structures comprises a pair of cylindrical surfaces spaced apart horizontally, wherein said plurality of vertically spaced apart ramp mounting structures include a ramp mounting structure above said pair of cylindrical surfaces extending from said step, and wherein said step is movable between a position extending downward between said horizontally spaced apart side frames and a position extending outward from said horizontally spaced apart side frames; and a ramp including an attachment structure removably attachable to each of said ramp mounting structures to pivotally attach said ramp to extend to said dock from said ladder, wherein said attachment structure comprises a bracket having a downwardly open slot for engaging each pair of said cylindrical surfaces spaced apart horizontally.

5. A gangway to accommodate passage between a dock and a boat, wherein said gangway comprises:

a ladder including a boat mounting structure for removably attaching said ladder to extend downward along a side of said boat and a plurality of vertically spaced apart ramp mounting structures, and a pair of horizontally spaced apart side frames, each having a pair of horizontally spaced apart slots, wherein each of said ramp mounting structures comprises a pair of cylindrical surfaces spaced apart horizontally, wherein said ramp mounting structures include a pair of pins forming cylindrical surfaces extending within said frames adjacent said horizontally spaced apart slots; and a ramp including an attachment structure removably attachable to each of said ramp mounting structure to pivotally attach said ramp to extend to said dock from said ladder, wherein said attachment structure comprises a bracket having a downwardly open slot for engaging each pair of said cylindrical surfaces spaced apart horizontally, wherein said brackets within said attachment structure extend within said horizontally spaced apart slots to engage said pair of pins.

6. A gangway to accommodate passage between a dock and a boat, wherein said gangway comprises:

a ladder including a boat mounting structure for removably attaching said ladder to extend downward along a side of said boat and a plurality of vertically spaced apart ramp mounting structures, and a pair of horizontally spaced apart side frames, wherein said plurality of vertically spaced apart ramp mounting structures includes a plurality of pairs of horizontally spaced apart slots in said horizontally spaced apart side frames, and a ramp mounting bracket pivotally attached to said ladder; and a ramp including an attachment structure removably attachable to each of said ramp mounting structures to pivotally attach said ramp to extend to said dock from said ladder, and wherein said ramp mounting bracket includes a pair of attachment tabs extending within a pair of said horizontally spaced apart slots to removably attach said mounting bracket to said ladder.

7. The gangway of claim 6, wherein said ramp mounting bracket is removably attached to said ladder by inserting said pair of attachment tabs within said horizontally spaced apart slots with said ramp mounting bracket extending upward and by then pivoting said ramp mounting bracket to extend outward.

8. The gangway of claim 6, wherein said ramp mounting bracket is removably attached to said ramp.

9. The gangway of claim 8, wherein said ramp mounting bracket includes a pair of cylindrical surfaces spaced apart horizontally, and said ramp includes a bracket having a downwardly open slot for engaging each of said cylindrical surfaces.

10. The gangway of claim 6, wherein said ramp mounting bracket includes a step surfaces extending horizontally from an end of said ramp.

11. The gangway of claim 6, wherein said ramp mounting bracket includes a step surface extending above an end of said ramp.

12. The gangway of claim 6, additionally comprising a step including a pair of attachment tabs extending within a pair of said horizontally spaced apart slots to removably attach said step to said ladder.

13. The gangway of claim 12, wherein said step is removably attached to said ladder by inserting said pair of attachment tabs of said step within said horizontally spaced apart slots with said step extending upward and by then pivoting said step to extend outward.

14. The gangway of claim 12, wherein said plurality of vertically spaced apart ramp mounting structures extend along a first side of said ladder.

said ladder additionally includes an additional pair of horizontally spaced apart slots extending along a side of said ladder opposite said first side of said ladder, and said step is removably attachable within said additional pair of horizontally spaced apart slots.

15. A gangway to accommodate passage between a dock and a boat, wherein said gangway comprises;

a ladder including a boat mounting structure for removably attaching said ladder to extend downward along a side of said boat and a plurality of vertically spaced apart ramp mounting structures;

a ramp including an attachment structure removably attachable to each of said ramp mounting structures to pivotally attach said ramp to extend to said dock from said ladder; and a step removably attachable to each of said ramp mounting structures.

16. The gangway of claim 15, wherein said plurality of vertically spaced apart ramp mounting structures extend along a first side of said ladder, said ladder additionally includes an additional mounting structure extending along a side of said ladder opposite said first side of said ladder, and said step is removably attachable within said additional mounting structure.

* * * * *